US009947293B2

(12) United States Patent
Chaji

(10) Patent No.: US 9,947,293 B2
(45) Date of Patent: Apr. 17, 2018

(54) SYSTEMS AND METHODS OF REDUCED MEMORY BANDWIDTH COMPENSATION

(71) Applicant: Ignis Innovation Inc., Waterloo (CA)

(72) Inventor: Gholamreza Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 0 days.

(21) Appl. No.: 15/165,435

(22) Filed: May 26, 2016

(65) Prior Publication Data

US 2016/0351094 A1 Dec. 1, 2016

(30) Foreign Application Priority Data

May 27, 2015 (CA) ..... 2892714

(51) Int. Cl.

*G09G 3/00* (2006.01)
*G09G 5/02* (2006.01)
*G09G 3/3225* (2016.01)

(52) U.S. Cl.

CPC ..... *G09G 5/026* (2013.01); *G09G 3/3225* (2013.01); *G09G 2320/029* (2013.01); *G09G 2320/0223* (2013.01); *G09G 2320/0285* (2013.01); *G09G 2320/041* (2013.01); *G09G 2320/043* (2013.01); *G09G 2320/045* (2013.01); *G09G 2340/04* (2013.01); *G09G 2350/00* (2013.01)

(58) Field of Classification Search

None

See application file for complete search history.

(56) References Cited

U.S. PATENT DOCUMENTS

| | | | |
|---|---|---|---|
| 3,506,851 | A | 4/1970 | Polkinghorn |
| 3,774,055 | A | 11/1973 | Bapat |
| 4,090,096 | A | 5/1978 | Nagami |
| 4,160,934 | A | 7/1979 | Kirsch |
| 4,295,091 | A | 10/1981 | Ponkala |
| 4,354,162 | A | 10/1982 | Wright |
| 4,943,956 | A | 7/1990 | Noro |
| 4,996,523 | A | 2/1991 | Bell |
| 5,153,420 | A | 10/1992 | Hack |
| 5,198,803 | A | 3/1993 | Shie |
| 5,204,661 | A | 4/1993 | Hack |
| 5,266,515 | A | 11/1993 | Robb |

(Continued)

FOREIGN PATENT DOCUMENTS

| | | |
|---|---|---|
| CA | 1 294 034 | 1/1992 |
| CA | 2 109 951 | 11/1992 |

(Continued)

OTHER PUBLICATIONS

Ahnood: "Effect of threshold voltage instability on field effect mobility in thin film transistors deduced from constant current measurements"; dated Aug. 2009.

(Continued)

*Primary Examiner* — Ryan M Gray

(74) *Attorney, Agent, or Firm* — Nixon Peabody LLP

(57) ABSTRACT

What is disclosed are systems and methods of compensation of images produced by active matrix light emitting diode device (AMOLED) and other emissive displays. Sub-sampling of pixel measurement data utilized in compensation of the display is utilized to reduce the data bandwidth between memory and a compensation module where the data is locally interpolated.

20 Claims, 4 Drawing Sheets

(56) References Cited

U.S. PATENT DOCUMENTS 5,489,918 A 2/1996 Mosier
5,498,880 A 3/1996 Lee
5,557,342 A 9/1996 Eto
5,561,381 A 10/1996 Jenkins et al.
5,572,444 A 11/1996 Lentz
5,589,847 A 12/1996 Lewis
5,619,033 A 4/1997 Weisfield
5,648,276 A 7/1997 Hara
5,670,973 A 9/1997 Bassetti
5,684,365 A 11/1997 Tang
5,691,783 A 11/1997 Numao
5,703,618 A * 12/1997 Eglit ..... G06T 3/4007 345/520
5,714,968 A 2/1998 Ikeda
5,723,950 A 3/1998 Wei
5,744,824 A 4/1998 Kousai
5,745,660 A 4/1998 Kolpatzik
5,748,160 A 5/1998 Shieh
5,815,303 A 9/1998 Berlin
5,870,071 A 2/1999 Kawahata
5,874,803 A 2/1999 Garbuzov
5,880,582 A 3/1999 Sawada
5,903,248 A 5/1999 Irwin
5,917,280 A 6/1999 Burrows
5,923,794 A 7/1999 McGrath
5,945,972 A 8/1999 Okumura
5,949,398 A 9/1999 Kim
5,952,789 A 9/1999 Stewart
5,952,991 A 9/1999 Akiyama
5,982,104 A 11/1999 Sasaki
5,990,629 A 11/1999 Yamada
6,023,259 A 2/2000 Howard
6,069,365 A 5/2000 Chow
6,091,203 A 7/2000 Kawashima
6,097,360 A 8/2000 Holloman
6,144,222 A 11/2000 Ho
6,177,915 B1 1/2001 Beeteson
6,229,506 B1 5/2001 Dawson
6,229,508 B1 5/2001 Kane
6,246,180 B1 6/2001 Nishigaki
6,252,248 B1 6/2001 Sano
6,259,424 B1 7/2001 Kurogane
6,262,589 B1 7/2001 Tamukai
6,271,825 B1 8/2001 Greene
6,288,696 B1 9/2001 Holloman
6,304,039 B1 10/2001 Appelberg
6,307,322 B1 10/2001 Dawson
6,310,962 B1 10/2001 Chung
6,320,325 B1 11/2001 Cok
6,323,631 B1 11/2001 Juang
6,329,971 B2 12/2001 McKnight
6,356,029 B1 3/2002 Hunter
6,373,454 B1 4/2002 Knapp
6,377,237 B1 4/2002 Sojourner
6,392,617 B1 5/2002 Gleason
6,404,139 B1 6/2002 Sasaki et al.
6,414,661 B1 7/2002 Shen
6,417,825 B1 7/2002 Stewart
6,433,488 B1 8/2002 Bu
6,437,106 B1 8/2002 Stoner
6,445,369 B1 9/2002 Yang
6,475,845 B2 11/2002 Kimura
6,501,098 B2 12/2002 Yarnazaki
6,501,466 B1 12/2002 Yamagishi
6,518,962 B2 2/2003 Kimura
6,522,315 B2 2/2003 Ozawa
6,525,683 B1 2/2003 Gu
6,531,827 B2 3/2003 Kawashima
6,541,921 B1 4/2003 Luciano, Jr. et al.
6,542,138 B1 4/2003 Shannon
6,555,420 B1 4/2003 Yarnazaki
6,580,408 B1 6/2003 Bae
6,580,657 B2 6/2003 Sanford
6,583,398 B2 6/2003 Harkin
6,583,775 B1 6/2003 Sekiya
6,594,606 B2 7/2003 Everitt
6,618,030 B2 9/2003 Kane
6,639,244 B1 10/2003 Yamazaki
6,668,645 B1 12/2003 Gilmour
6,677,713 B1 1/2004 Sung
6,680,580 B1 1/2004 Sung
6,687,266 B1 2/2004 Ma
6,690,000 B1 2/2004 Muramatsu
6,690,344 B1 2/2004 Takeuchi
6,693,388 B2 2/2004 Oomura
6,693,610 B2 2/2004 Shannon
6,697,057 B2 2/2004 Koyama
6,720,942 B2 4/2004 Lee
6,724,151 B2 4/2004 Yoo
6,734,636 B2 5/2004 Sanford
6,738,034 B2 5/2004 Kaneko
6,738,035 B1 5/2004 Fan
6,753,655 B2 6/2004 Shih
6,753,834 B2 6/2004 Mikami
6,756,741 B2 6/2004 Li
6,756,952 B1 6/2004 Decaux
6,756,958 B2 6/2004 Furuhashi
6,765,549 B1 7/2004 Yamazaki et al.
6,771,028 B1 8/2004 Winters
6,777,712 B2 8/2004 Sanford
6,777,888 B2 8/2004 Kondo
6,781,567 B2 8/2004 Kimura
6,806,497 B2 10/2004 Jo
6,806,638 B2 10/2004 Lih et al.
6,806,857 B2 10/2004 Sempel
6,809,706 B2 10/2004 Shimoda
6,815,975 B2 11/2004 Nara
6,817,721 B1 * 11/2004 Ulichney ..... G09G 3/002 345/596
6,828,950 B2 12/2004 Koyama
6,853,371 B2 2/2005 Miyajima
6,859,193 B1 2/2005 Yumoto
6,873,117 B2 3/2005 Ishizuka
6,876,346 B2 4/2005 Anzai
6,885,356 B2 4/2005 Hashimoto
6,900,485 B2 5/2005 Lee
6,903,734 B2 6/2005 Eu
6,909,243 B2 6/2005 Inukai
6,909,419 B2 6/2005 Zavracky
6,911,960 B1 6/2005 Yokoyama
6,911,964 B2 6/2005 Lee
6,914,448 B2 7/2005 Jinno
6,919,871 B2 7/2005 Kwon
6,924,602 B2 8/2005 Komiya
6,937,215 B2 8/2005 Lo
6,937,220 B2 8/2005 Kitaura
6,940,214 B1 9/2005 Komiya
6,943,500 B2 9/2005 LeChevalier
6,947,022 B2 9/2005 McCartney
6,954,194 B2 10/2005 Matsumoto
6,956,547 B2 10/2005 Bae
6,975,142 B2 12/2005 Azami
6,975,332 B2 12/2005 Arnold
6,995,510 B2 2/2006 Murakami
6,995,519 B2 2/2006 Arnold
7,023,408 B2 4/2006 Chen
7,027,015 B2 4/2006 Booth, Jr.
7,027,078 B2 4/2006 Reihl
7,034,793 B2 4/2006 Sekiya
7,038,392 B2 5/2006 Libsch
7,053,875 B2 5/2006 Chou
6,577,302 B2 6/2006 Hunter
7,057,359 B2 6/2006 Hung
7,061,451 B2 6/2006 Kimura
7,064,733 B2 6/2006 Cok
7,071,932 B2 7/2006 Libsch
7,088,051 B1 8/2006 Cok
7,088,052 B2 8/2006 Kimura
7,102,378 B2 9/2006 Kuo
7,106,285 B2 9/2006 Naugler
7,112,820 B2 9/2006 Chang
7,116,058 B2 10/2006 Lo
7,119,493 B2 10/2006 Fryer
7,122,835 B1 10/2006 Ikeda

(56) References Cited

U.S. PATENT DOCUMENTS 7,127,380 B1 10/2006 Iverson
7,129,914 B2 10/2006 Knapp
7,161,566 B2 1/2007 Cok
7,164,417 B2 1/2007 Cok
7,193,589 B2 3/2007 Yoshida
7,224,332 B2 5/2007 Cok
7,227,519 B1 6/2007 Kawase
7,245,277 B2 7/2007 Ishizuka
7,246,912 B2 7/2007 Burger et al.
7,248,236 B2 7/2007 Nathan
7,262,753 B2 8/2007 Tanghe
7,274,363 B2 9/2007 Ishizuka
7,310,092 B2 12/2007 Imamura
7,315,295 B2 1/2008 Kimura
7,321,348 B2 1/2008 Cok
7,339,560 B2 3/2008 Sun
7,355,574 B1 4/2008 Leon
7,358,941 B2 4/2008 Ono
7,368,868 B2 5/2008 Sakamoto
7,397,485 B2 7/2008 Miller
7,411,571 B2 8/2008 Huh
7,414,600 B2 8/2008 Nathan
7,423,617 B2 9/2008 Giraldo
7,453,054 B2 11/2008 Lee
7,474,285 B2 1/2009 Kimura
7,502,000 B2 3/2009 Yuki
7,528,812 B2 5/2009 Tsuge
7,535,449 B2 5/2009 Miyazawa
7,554,512 B2 6/2009 Steer
7,569,849 B2 8/2009 Nathan
7,576,718 B2 8/2009 Miyazawa
7,580,012 B2 8/2009 Kim
7,589,707 B2 9/2009 Chou
7,605,792 B2 10/2009 Son
7,609,239 B2 10/2009 Chang
7,619,594 B2 11/2009 Hu
7,619,597 B2 11/2009 Nathan
7,633,470 B2 12/2009 Kane
7,656,370 B2 2/2010 Schneider
7,675,485 B2 3/2010 Steer
7,800,558 B2 9/2010 Routley
7,847,764 B2 12/2010 Cok
7,859,492 B2 12/2010 Kohno
7,868,859 B2 1/2011 Tomida
7,876,294 B2 1/2011 Sasaki
7,924,249 B2 4/2011 Nathan
7,932,883 B2 4/2011 Klompenhouwer
7,969,390 B2 6/2011 Yoshida
7,978,187 B2 7/2011 Nathan
7,994,712 B2 8/2011 Sung
8,026,876 B2 9/2011 Nathan
8,031,180 B2 10/2011 Miyamoto et al.
8,049,420 B2 11/2011 Tamura
8,077,123 B2 12/2011 Naugler, Jr.
8,115,707 B2 2/2012 Nathan
8,208,084 B2 6/2012 Lin
8,223,177 B2 7/2012 Nathan
8,232,939 B2 7/2012 Nathan
8,259,044 B2 9/2012 Nathan
8,264,431 B2 9/2012 Bulovic
8,279,143 B2 10/2012 Nathan
8,294,696 B2 10/2012 Min et al.
8,314,783 B2 11/2012 Sambandan et al.
8,339,386 B2 12/2012 Leon
8,441,206 B2 5/2013 Myers
8,493,296 B2 7/2013 Ogawa
8,581,809 B2 11/2013 Nathan et al.
9,125,278 B2 9/2015 Nathan et al.
2001/0002703 A1 6/2001 Koyama
2001/0009283 A1 7/2001 Arao
2001/0024181 A1 9/2001 Kubota
2001/0024186 A1 9/2001 Kane
2001/0026257 A1 10/2001 Kimura
2001/0030323 A1 10/2001 Ikeda
2001/0035863 A1 11/2001 Kimura
2001/0038367 A1 11/2001 Inukai
2001/0040541 A1 11/2001 Yoneda
2001/0043173 A1 11/2001 Troutman
2001/0045929 A1 11/2001 Prache
2001/0052606 A1 12/2001 Sempel et al.
2001/0052940 A1 12/2001 Hagihara
2002/0000576 A1 1/2002 Inukai
2002/0011796 A1 1/2002 Koyama
2002/0011799 A1 1/2002 Kimura
2002/0012057 A1 1/2002 Kimura
2002/0014851 A1 2/2002 Tai
2002/0018034 A1 2/2002 Ohki
2002/0030190 A1 3/2002 Ohtani
2002/0047565 A1 4/2002 Nara
2002/0052086 A1 5/2002 Maeda
2002/0067134 A1 6/2002 Kawashima
2002/0084463 A1 7/2002 Sanford
2002/0101152 A1 8/2002 Kimura
2002/0101172 A1 8/2002 Bu
2002/0105279 A1 8/2002 Kimura
2002/0117722 A1 8/2002 Osada
2002/0122044 A1* 9/2002 Deering ..... G06F 3/1431 345/597
2002/0122308 A1 9/2002 Ikeda
2002/0158587 A1 10/2002 Komiya
2002/0158666 A1 10/2002 Azami
2002/0158823 A1 10/2002 Zavracky
2002/0167471 A1 11/2002 Everitt
2002/0167474 A1 11/2002 Everitt
2002/0169575 A1 11/2002 Everitt
2002/0180369 A1 12/2002 Koyama
2002/0180721 A1 12/2002 Kimura
2002/0181276 A1 12/2002 Yamazaki
2002/0183945 A1 12/2002 Everitt
2002/0186214 A1 12/2002 Siwinski
2002/0190924 A1 12/2002 Asano
2002/0190971 A1 12/2002 Nakamura
2002/0195967 A1 12/2002 Kim
2002/0195968 A1 12/2002 Sanford
2003/0020413 A1 1/2003 Oomura
2003/0030603 A1 2/2003 Shimoda
2003/0043088 A1 3/2003 Booth
2003/0057895 A1 3/2003 Kimura
2003/0058226 A1 3/2003 Bertram
2003/0062524 A1 4/2003 Kimura
2003/0063081 A1 4/2003 Kimura
2003/0071821 A1 4/2003 Sundahl
2003/0076048 A1 4/2003 Rutherford
2003/0090447 A1 5/2003 Kimura
2003/0090481 A1 5/2003 Kimura
2003/0107560 A1 6/2003 Yumoto
2003/0111966 A1 6/2003 Mikami
2003/0122745 A1 7/2003 Miyazawa
2003/0122749 A1 7/2003 Booth, Jr. et al.
2003/0122813 A1 7/2003 Ishizuki
2003/0142088 A1 7/2003 LeChevalier
2003/0146897 A1 8/2003 Hunter
2003/0151569 A1 8/2003 Lee
2003/0156101 A1 8/2003 Le Chevalier
2003/0169241 A1 9/2003 LeChevalier
2003/0174152 A1 9/2003 Noguchi
2003/0179626 A1 9/2003 Sanford
2003/0185438 A1 10/2003 Osawa
2003/0197663 A1 10/2003 Lee
2003/0210256 A1 11/2003 Mori
2003/0230141 A1 12/2003 Gilmour
2003/0230980 A1 12/2003 Forrest
2003/0231148 A1 12/2003 Lin
2003/0234796 A1* 12/2003 Bakhmutsky ..... G09G 3/3611 345/606
2004/0032382 A1 2/2004 Cok
2004/0041750 A1 3/2004 Abe
2004/0066357 A1 4/2004 Kawasaki
2004/0070557 A1 4/2004 Asano
2004/0070565 A1 4/2004 Nayar
2004/0090186 A1 5/2004 Kanauchi
2004/0090400 A1 5/2004 Yoo
2004/0095297 A1 5/2004 Libsch
2004/0100427 A1 5/2004 Miyazawa

(56) References Cited

U.S. PATENT DOCUMENTS

2004/0108518 A1 6/2004 Jo
2004/0135749 A1 7/2004 Kondakov
2004/0140982 A1 7/2004 Pate
2004/0145547 A1 7/2004 Oh
2004/0150592 A1 8/2004 Mizukoshi
2004/0150594 A1 8/2004 Koyama
2004/0150595 A1 8/2004 Kasai
2004/0155841 A1 8/2004 Kasai
2004/0174347 A1 9/2004 Sun
2004/0174349 A1 9/2004 Libsch
2004/0174354 A1 9/2004 Ono
2004/0178743 A1 9/2004 Miller
2004/0183759 A1 9/2004 Stevenson
2004/0196275 A1 10/2004 Hattori
2004/0207615 A1 10/2004 Yumoto
2004/0227697 A1 11/2004 Mori
2004/0233125 A1 11/2004 Tanghe
2004/0239596 A1 12/2004 Ono
2004/0246246 A1 12/2004 Tobita
2004/0252089 A1 12/2004 Ono
2004/0257313 A1 12/2004 Kawashima
2004/0257353 A1 12/2004 Imamura
2004/0257355 A1 12/2004 Naugler
2004/0263437 A1 12/2004 Hattori
2004/0263444 A1 12/2004 Kimura
2004/0263445 A1 12/2004 Inukai
2004/0263541 A1 12/2004 Takeuchi
2005/0007355 A1 1/2005 Miura
2005/0007357 A1 1/2005 Yamashita
2005/0007392 A1 1/2005 Kasai
2005/0017650 A1 1/2005 Fryer
2005/0024081 A1 2/2005 Kuo
2005/0024393 A1 2/2005 Kondo
2005/0030267 A1 2/2005 Tanghe
2005/0057484 A1 3/2005 Diefenbaugh
2005/0057580 A1 3/2005 Yamano
2005/0067970 A1 3/2005 Libsch
2005/0067971 A1 3/2005 Kane
2005/0068270 A1 3/2005 Awakura
2005/0068275 A1 3/2005 Kane
2005/0073264 A1 4/2005 Matsumoto
2005/0083323 A1 4/2005 Suzuki
2005/0088103 A1 4/2005 Kageyama
2005/0105031 A1 5/2005 Shih
2005/0110420 A1 5/2005 Arnold
2005/0110807 A1 5/2005 Chang
2005/0122294 A1 6/2005 Ben-David
2005/0140598 A1 6/2005 Kim
2005/0140610 A1 6/2005 Smith
2005/0145891 A1 7/2005 Abe
2005/0156831 A1 7/2005 Yamazaki
2005/0162079 A1 7/2005 Sakamoto
2005/0168416 A1 8/2005 Hashimoto
2005/0179626 A1 8/2005 Yuki
2005/0179628 A1 8/2005 Kimura
2005/0185200 A1 8/2005 Tobol
2005/0200575 A1 9/2005 Kim
2005/0206590 A1 9/2005 Sasaki
2005/0212787 A1 9/2005 Noguchi
2005/0219184 A1 10/2005 Zehner
2005/0225683 A1 10/2005 Nozawa
2005/0248515 A1 11/2005 Naugler
2005/0269959 A1 12/2005 Uchino
2005/0269960 A1 12/2005 Ono
2005/0280615 A1 12/2005 Cok
2005/0280766 A1 12/2005 Johnson
2005/0285822 A1 12/2005 Reddy
2005/0285825 A1 12/2005 Eom
2006/0001613 A1 1/2006 Routley
2006/0007072 A1 1/2006 Choi
2006/0007206 A1 1/2006 Reddy et al.
2006/0007249 A1 1/2006 Reddy
2006/0012310 A1 1/2006 Chen
2006/0012311 A1 1/2006 Ogawa
2006/0015272 A1 1/2006 Giraldo et al.
2006/0022305 A1 2/2006 Yamashita
2006/0022907 A1 2/2006 Uchino et al.
2006/0027807 A1 2/2006 Nathan
2006/0030084 A1 2/2006 Young
2006/0038501 A1 2/2006 Koyama et al.
2006/0038758 A1 2/2006 Routley
2006/0038762 A1 2/2006 Chou
2006/0044227 A1 3/2006 Hadcock
2006/0061248 A1 3/2006 Cok
2006/0066533 A1 3/2006 Sato
2006/0077134 A1 4/2006 Hector et al.
2006/0077135 A1 4/2006 Cok
2006/0077142 A1 4/2006 Kwon
2006/0082523 A1 4/2006 Guo
2006/0092185 A1 5/2006 Jo
2006/0097628 A1 5/2006 Suh
2006/0097631 A1 5/2006 Lee
2006/0103324 A1 5/2006 Kim et al.
2006/0103611 A1 5/2006 Choi
2006/0125740 A1 6/2006 Shirasaki et al.
2006/0149493 A1 7/2006 Sambandan
2006/0170623 A1 8/2006 Naugler, Jr.
2006/0176250 A1 8/2006 Nathan
2006/0208961 A1 9/2006 Nathan
2006/0208971 A1 9/2006 Deane
2006/0214888 A1 9/2006 Schneider
2006/0231740 A1 10/2006 Kasai
2006/0232522 A1 10/2006 Roy
2006/0244697 A1 11/2006 Lee
2006/0256048 A1 11/2006 Fish et al.
2006/0261841 A1 11/2006 Fish
2006/0273997 A1 12/2006 Nathan
2006/0279481 A1 12/2006 Haruna
2006/0284801 A1 12/2006 Yoon
2006/0284802 A1 12/2006 Kohno
2006/0284895 A1 12/2006 Marcu
2006/0290614 A1 12/2006 Nathan
2006/0290618 A1 12/2006 Goto
2007/0001937 A1 1/2007 Park
2007/0001939 A1 1/2007 Hashimoto
2007/0008251 A1 1/2007 Kohno
2007/0008268 A1 1/2007 Park
2007/0008297 A1 1/2007 Bassetti
2007/0057873 A1 3/2007 Uchino
2007/0057874 A1 3/2007 Le Roy
2007/0069998 A1 3/2007 Naugler
2007/0075727 A1 4/2007 Nakano
2007/0076226 A1 4/2007 Klompenhouwer
2007/0080905 A1 4/2007 Takahara
2007/0080906 A1 4/2007 Tanabe
2007/0080908 A1 4/2007 Nathan
2007/0097038 A1 5/2007 Yamazaki
2007/0097041 A1 5/2007 Park
2007/0103411 A1* 5/2007 Cok ..... G09G 3/3216 345/82
2007/0103419 A1 5/2007 Uchino
2007/0115221 A1 5/2007 Buchhauser
2007/0126672 A1 6/2007 Tada et al.
2007/0164664 A1 7/2007 Ludwicki
2007/0164937 A1 7/2007 Jung et al.
2007/0164938 A1 7/2007 Shin
2007/0182671 A1 8/2007 Nathan
2007/0236134 A1 10/2007 Ho
2007/0236440 A1 10/2007 Wacyk
2007/0236517 A1 10/2007 Kimpe
2007/0241999 A1 10/2007 Lin
2007/0273294 A1 11/2007 Nagayama
2007/0285359 A1 12/2007 Ono
2007/0290957 A1 12/2007 Cok
2007/0290958 A1 12/2007 Cok
2007/0296672 A1 12/2007 Kim
2008/0001525 A1 1/2008 Chao
2008/0001544 A1 1/2008 Murakami
2008/0030518 A1 2/2008 Higgins
2008/0036706 A1 2/2008 Kitazawa
2008/0036708 A1 2/2008 Shirasaki
2008/0042942 A1 2/2008 Takahashi
2008/0042948 A1 2/2008 Yamashita
2008/0048951 A1 2/2008 Naugler, Jr.

(56) References Cited

U.S. PATENT DOCUMENTS

2008/0055209 A1 3/2008 Cok
2008/0055211 A1 3/2008 Ogawa
2008/0074413 A1 3/2008 Ogura
2008/0088549 A1 4/2008 Nathan
2008/0088648 A1 4/2008 Nathan
2008/0111766 A1 5/2008 Uchino
2008/0116787 A1 5/2008 Hsu
2008/0117144 A1 5/2008 Nakano et al.
2008/0136770 A1 6/2008 Peker et al.
2008/0150845 A1 6/2008 Ishii
2008/0150847 A1 6/2008 Kim
2008/0158115 A1 7/2008 Cordes
2008/0158648 A1 7/2008 Cummings
2008/0191976 A1 8/2008 Nathan
2008/0198103 A1 8/2008 Toyomura
2008/0211749 A1 9/2008 Weitbruch
2008/0218451 A1 9/2008 Miyamoto
2008/0231558 A1 9/2008 Naugler
2008/0231562 A1 9/2008 Kwon
2008/0231625 A1 9/2008 Minami
2008/0246713 A1 10/2008 Lee
2008/0252223 A1 10/2008 Toyoda
2008/0252571 A1 10/2008 Hente
2008/0259020 A1 10/2008 Fisekovic
2008/0278421 A1* 11/2008 Inoue ..... G09G 3/3233 345/77
2008/0290805 A1 11/2008 Yamada
2008/0297055 A1 12/2008 Miyake
2009/0033598 A1 2/2009 Suh
2009/0058772 A1 3/2009 Lee
2009/0109142 A1 4/2009 Takahara
2009/0121994 A1 5/2009 Miyata
2009/0146926 A1 6/2009 Sung
2009/0160743 A1 6/2009 Tomida
2009/0174628 A1 7/2009 Wang
2009/0184901 A1 7/2009 Kwon
2009/0195483 A1 8/2009 Naugler, Jr.
2009/0201281 A1 8/2009 Routley
2009/0206764 A1 8/2009 Schemmann
2009/0207160 A1 8/2009 Shirasaki et al.
2009/0213046 A1 8/2009 Nam
2009/0244046 A1 10/2009 Seto
2009/0262047 A1 10/2009 Yamashita et al.
2010/0004891 A1 1/2010 Ahlers
2010/0026725 A1 2/2010 Smith
2010/0039422 A1 2/2010 Seto
2010/0039458 A1 2/2010 Nathan
2010/0045646 A1 2/2010 Kishi
2010/0045650 A1 2/2010 Fish et al.
2010/0060911 A1 3/2010 Marcu
2010/0073335 A1 3/2010 Min et al.
2010/0073357 A1 3/2010 Min et al.
2010/0079419 A1 4/2010 Shibusawa
2010/0085282 A1 4/2010 Yu
2010/0103160 A1 4/2010 Jeon
2010/0134469 A1 6/2010 Ogura et al.
2010/0134475 A1 6/2010 Ogura et al.
2010/0165002 A1 7/2010 Ahn
2010/0194670 A1 8/2010 Cok
2010/0207960 A1 8/2010 Kimpe
2010/0225630 A1 9/2010 Levey
2010/0251295 A1 9/2010 Amento
2010/0277400 A1 11/2010 Jeong
2010/0315319 A1 12/2010 Cok
2011/0032281 A1* 2/2011 Ietomi ..... G09G 3/3233 345/690
2011/0050744 A1* 3/2011 Kikuta ..... G09G 3/3233 345/690
2011/0050870 A1 3/2011 Hanari
2011/0063197 A1 3/2011 Chung
2011/0069051 A1 3/2011 Nakamura
2011/0069089 A1 3/2011 Kopf
2011/0069096 A1 3/2011 Li
2011/0074750 A1 3/2011 Leon
2011/0074762 A1 3/2011 Shirasaki et al.
2011/0149166 A1 6/2011 Botzas
2011/0169798 A1 7/2011 Lee
2011/0175895 A1 7/2011 Hayakawa
2011/0181630 A1 7/2011 Smith
2011/0199395 A1 8/2011 Nathan
2011/0227964 A1 9/2011 Chaji
2011/0242074 A1 10/2011 Bert et al.
2011/0273399 A1 11/2011 Lee
2011/0279488 A1 11/2011 Nathan et al.
2011/0292006 A1 12/2011 Kim
2011/0293480 A1 12/2011 Mueller
2012/0056558 A1 3/2012 Toshiya
2012/0062565 A1 3/2012 Fuchs
2012/0075354 A1* 3/2012 Su ..... G09G 5/10 345/690
2012/0262184 A1 10/2012 Shen
2012/0299970 A1 11/2012 Bae
2012/0299978 A1 11/2012 Chaji
2013/0027381 A1 1/2013 Nathan
2013/0057595 A1 3/2013 Nathan
2013/0112960 A1 5/2013 Chaji
2013/0135272 A1 5/2013 Park
2013/0162617 A1 6/2013 Yoon
2013/0201223 A1 8/2013 Li et al.
2013/0241813 A1 9/2013 Tanaka
2013/0278578 A1* 10/2013 Vetsuypens ..... G09G 3/20 345/207
2013/0309821 A1 11/2013 Yoo
2013/0321671 A1 12/2013 Cote
2014/0015824 A1 1/2014 Chaji et al.
2014/0022289 A1 1/2014 Lee et al.
2014/0043316 A1 2/2014 Chaji et al.
2014/0055500 A1 2/2014 Lai
2014/0111567 A1 4/2014 Nathan et al.
2014/0300756 A1* 10/2014 Murase ..... H04N 17/00 348/189
2015/0213757 A1* 7/2015 Takahama ..... G09G 3/3291 345/691
2015/0213771 A1* 7/2015 Ohnishi ..... G01J 3/46 345/88
2015/0229919 A1* 8/2015 Weber ..... G01J 3/506 348/184
2016/0275860 A1 9/2016 Wu

FOREIGN PATENT DOCUMENTS

CA 2 249 592 7/1998
CA 2 368 386 9/1999
CA 2 242 720 1/2000
CA 2 354 018 6/2000
CA 2 432 530 7/2002
CA 2 436 451 8/2002
CA 2 438 577 8/2002
CA 2 463 653 1/2004
CA 2 498 136 3/2004
CA 2 522 396 11/2004
CA 2 443 206 3/2005
CA 2 472 671 12/2005
CA 2 567 076 1/2006
CA 2526436 2/2006
CA 2 526 782 4/2006
CA 2 541 531 7/2006
CA 2 550 102 4/2008
CA 2 773 699 10/2013
CN 1381032 11/2002
CN 1448908 10/2003
CN 1682267 A 10/2005
CN 1760945 4/2006
CN 1886774 12/2006
CN 101449311 6/2009
CN 102656621 9/2012
EP 0 158 366 10/1985
EP 1 028 471 8/2000
EP 1 111 577 6/2001
EP 1 130 565 A1 9/2001
EP 1 194 013 4/2002
EP 1 335 430 A1 8/2003
EP 1 372 136 12/2003

(56) References Cited

FOREIGN PATENT DOCUMENTS

| | | | |
|---|---|---|---|
| EP | 1 381 019 | | 1/2004 |
| EP | 1 418 566 | | 5/2004 |
| EP | 1 429 312 | A | 6/2004 |
| EP | 145 0341 | A | 8/2004 |
| EP | 1 465 143 | A | 10/2004 |
| EP | 1 469 448 | A | 10/2004 |
| EP | 1 521 203 | A2 | 4/2005 |
| EP | 1 594 347 | | 11/2005 |
| EP | 1 784 055 | A2 | 5/2007 |
| EP | 1854338 | A1 | 11/2007 |
| EP | 1 879 169 | A1 | 1/2008 |
| EP | 1 879 172 | | 1/2008 |
| EP | 2395499 | A1 | 12/2011 |
| GB | 2 389 951 | | 12/2003 |
| JP | 1272298 | | 10/1989 |
| JP | 4-042619 | | 2/1992 |
| JP | 6-314977 | | 11/1994 |
| JP | 8-340243 | | 12/1996 |
| JP | 09-090405 | | 4/1997 |
| JP | 10-254410 | | 9/1998 |
| JP | 11-202295 | | 7/1999 |
| JP | 11-219146 | | 8/1999 |
| JP | 11 231805 | | 8/1999 |
| JP | 11-282419 | | 10/1999 |
| JP | 2000-056847 | | 2/2000 |
| JP | 2000-81607 | | 3/2000 |
| JP | 2001-134217 | | 5/2001 |
| JP | 2001-195014 | | 7/2001 |
| JP | 2002-055654 | | 2/2002 |
| JP | 2002-91376 | | 3/2002 |
| JP | 2002-514320 | | 5/2002 |
| JP | 2002-229513 | | 8/2002 |
| JP | 2002-278513 | | 9/2002 |
| JP | 2002-333862 | | 11/2002 |
| JP | 2003-076331 | | 3/2003 |
| JP | 2003-124519 | | 4/2003 |
| JP | 2003-177709 | | 6/2003 |
| JP | 2003-271095 | | 9/2003 |
| JP | 2003-308046 | | 10/2003 |
| JP | 2003-317944 | | 11/2003 |
| JP | 2004-004675 | | 1/2004 |
| JP | 2004-045648 | | 2/2004 |
| JP | 2004-145197 | | 5/2004 |
| JP | 2004-287345 | | 10/2004 |
| JP | 2005-057217 | | 3/2005 |
| JP | 2007-065015 | | 3/2007 |
| JP | 2007-155754 | | 6/2007 |
| JP | 2008-102335 | | 5/2008 |
| JP | 4-158570 | | 10/2008 |
| JP | 2003-195813 | | 7/2013 |
| KR | 2004-0100887 | | 12/2004 |
| TW | 342486 | | 10/1998 |
| TW | 473622 | | 1/2002 |
| TW | 485337 | | 5/2002 |
| TW | 502233 | | 9/2002 |
| TW | 538650 | | 6/2003 |
| TW | 1221268 | | 9/2004 |
| TW | 1223092 | | 11/2004 |
| TW | 200727247 | | 7/2007 |
| WO | WO 1998/48403 | | 10/1998 |
| WO | WO 1999/48079 | | 9/1999 |
| WO | WO 2001/06484 | | 1/2001 |
| WO | WO 2001/27910 | A1 | 4/2001 |
| WO | WO 2001/63587 | A2 | 8/2001 |
| WO | WO 2002/067327 | A | 8/2002 |
| WO | WO 2003/001496 | A1 | 1/2003 |
| WO | WO 2003/034389 | A | 4/2003 |
| WO | WO 2003/058594 | A1 | 7/2003 |
| WO | WO 2003/063124 | | 7/2003 |
| WO | WO 2003/077231 | | 9/2003 |
| WO | WO 2004/003877 | | 1/2004 |
| WO | WO 2004/025615 | A | 3/2004 |
| WO | WO 2004/034364 | | 4/2004 |
| WO | WO 2004/047058 | | 6/2004 |
| WO | WO 2004/104975 | A1 | 12/2004 |
| WO | WO 2005/022498 | | 3/2005 |
| WO | WO 2005/022500 | A | 3/2005 |
| WO | WO 2005/029455 | | 3/2005 |
| WO | WO 2005/029456 | | 3/2005 |
| WO | WO/2005/034072 | A1 | 4/2005 |
| WO | WO 2005/055185 | | 6/2005 |
| WO | WO 2006/000101 | A1 | 1/2006 |
| WO | WO 2006/053424 | | 5/2006 |
| WO | WO 2006/063448 | A | 6/2006 |
| WO | WO 2006/084360 | | 8/2006 |
| WO | WO 2007/003877 | A | 1/2007 |
| WO | WO 2007/079572 | | 7/2007 |
| WO | WO 2007/120849 | A2 | 10/2007 |
| WO | WO 2009/048618 | | 4/2009 |
| WO | WO 2009/055920 | | 5/2009 |
| WO | WO 2010/023270 | | 3/2010 |
| WO | WO 2010/146707 | A1 | 12/2010 |
| WO | WO 2011/041224 | A1 | 4/2011 |
| WO | WO 2011/064761 | A1 | 6/2011 |
| WO | WO 2011/067729 | | 6/2011 |
| WO | WO 2012/160424 | A1 | 11/2012 |
| WO | WO 2012/160471 | | 11/2012 |
| WO | WO 2012/164474 | A2 | 12/2012 |
| WO | WO 2012/164475 | A2 | 12/2012 |

OTHER PUBLICATIONS

Alexander: "Pixel circuits and drive schemes for glass and elastic AMOLED displays"; dated Jul. 2005 (9 pages).

Alexander: "Unique Electrical Measurement Technology for Compensation, Inspection, and Process Diagnostics of AMOLED HDTV"; dated May 2010 (4 pages).

Ashtiani: "AMOLED Pixel Circuit With Electronic Compensation of Luminance Degradation"; dated Mar. 2007 (4 pages).

Chaji: "A Current-Mode Comparator for Digital Calibration of Amorphous Silicon AMOLED Displays"; dated Jul. 2008 (5 pages).

Chaji: "A fast settling current driver based on the CCII for AMOLED displays"; dated Dec. 2009 (6 pages).

Chaji: "A Low-Cost Stable Amorphous Silicon AMOLED Display with Full V~T—and V~O~L~E~D Shift Compensation"; dated May 2007 (4 pages).

Chaji: "A low-power driving scheme for a-Si:H active-matrix organic light-emitting diode displays"; dated Jun. 2005 (4 pages).

Chaji: "A low-power high-performance digital circuit for deep submicron technologies"; dated Jun. 2005 (4 pages).

Chaji: "A novel a-Si:H AMOLED pixel circuit based on short-term stress stability of a-Si:H TFTs"; dated Oct. 2005 (3 pages).

Chaji: "A Novel Driving Scheme and Pixel Circuit for AMOLED Displays"; dated Jun. 2006 (4 pages).

Chaji: "A Novel Driving Scheme for High Resolution Large-area a-Si:H AMOLED displays"; dated Aug. 2005 (3 pages).

Chaji: "A Stable Voltage-Programmed Pixel Circuit for a-Si:H AMOLED Displays"; dated Dec. 2006 (12 pages).

Chaji: "A Sub-μA fast-settling current-programmed pixel circuit for AMOLED displays"; dated Sep. 2007.

Chaji: "An Enhanced and Simplified Optical Feedback Pixel Circuit for AMOLED Displays"; dated Oct. 2006.

Chaji: "Compensation technique for DC and transient instability of thin film transistor circuits for large-area devices"; dated Aug. 2008.

Chaji: "Driving scheme for stable operation of 2-TFT a-Si AMOLED pixel"; dated Apr. 2005 (2 pages).

Chaji: "Dynamic-effect compensating technique for stable a-Si:H AMOLED displays"; dated Aug. 2005 (4 pages).

Chaji: "Electrical Compensation of OLED Luminance Degradation"; dated Dec. 2007 (3 pages).

Chaji: "eUTDSP: a design study of a new VLIW-based DSP architecture"; dated My 2003 (4 pages).

Chaji: "Fast and Offset-Leakage Insensitive Current-Mode Line Driver for Active Matrix Displays and Sensors"; dated Feb. 2009 (8 pages).

Chaji: "High Speed Low Power Adder Design With a New Logic Style: Pseudo Dynamic Logic (SDL)"; dated Oct. 2001 (4 pages).

Chaji: "High-precision, fast current source for large-area current-programmed a-Si flat panels"; dated Sep. 2006 (4 pages).

(56) References Cited

OTHER PUBLICATIONS

Chaji: "Low-Cost AMOLED Television with IGNIS Compensating Technology"; dated May 2008 (4 pages).
Chaji: "Low-Cost Stable a-Si:H AMOLED Display for Portable Applications"; dated Jun. 2006 (4 pages).
Chaji: "Low-Power Low-Cost Voltage-Programmed a-Si:H AMOLED Display"; dated Jun. 2008 (5 pages).
Chaji: "Merged phototransistor pixel with enhanced near infrared response and flicker noise reduction for biomolecular imaging"; dated Nov. 2008 (3 pages).
Chaji: "Parallel Addressing Scheme for Voltage-Programmed Active-Matrix OLED Displays"; dated May 2007 (6 pages).
Chaji: "Pseudo dynamic logic (SDL): a high-speed and low-power dynamic logic family"; dated 2002 (4 pages).
Chaji: "Stable a-Si:H circuits based on short-term stress stability of amorphous silicon thin film transistors"; dated May 2006 (4 pages).
Chaji: "Stable Pixel Circuit for Small-Area High-Resolution a-Si:H AMOLED Displays"; dated Oct. 2008 (6 pages).
Chaji: "Stable RGBW AMOLED display with OLED degradation compensation using electrical feedback"; dated Feb. 2010 (2 pages).
Chaji: "Thin-Film Transistor Integration for Biomedical Imaging and AMOLED Displays"; dated 2008 (177 pages).
European Search Report for Application No. EP 04 78 6661 dated Mar. 9, 2009.
European Search Report for Application No. EP 05 75 9141 dated Oct. 30, 2009 (2 pages).
European Search Report for Application No. EP 05 81 9617 dated Jan. 30, 2009.
European Search Report for Application No. EP 06 70 5133 dated Jul. 18, 2008.
European Search Report for Application No. EP 06 72 1798 dated Nov. 12, 2009 (2 pages).
European Search Report for Application No. EP 07 71 0608.6 dated Mar. 19, 2010 (7 pages).
European Search Report for Application No. EP 07 71 9579 dated May 20, 2009.
European Search Report for Application No. EP 07 81 5784 dated Jul. 20, 2010 (2 pages).
European Search Report for Application No. EP 10 16 6143, dated Sep. 3, 2010 (2 pages).
European Search Report for Application No. EP 10 83 4294.0-1903, dated Apr. 8, 2013, (9 pages).
European Supplementary Search Report for Application No. EP 04 78 6662 dated Jan. 19, 2007 (2 pages).
Extended European Search Report for Application No. 11 73 9485.8 dated Aug. 6, 2013 (14 pages).
Extended European Search Report for Application No. EP 09 73 3076.5, dated Apr. 27, (13 pages).
Extended European Search Report for Application No. EP 11 16 8677.0, dated Nov. 29, 2012, (13 page).
Extended European Search Report for Application No. EP 11 19 1641.7 dated Jul. 11, 2012 (14 pages).
Extended European Search Report for Application No. EP 10834297 dated Oct. 27, 2014 (6 pages).
Fossum, Eric R.. "Active Pixel Sensors: Are CCD's Dinosaurs?" SPIE: Symposium on Electronic Imaging. Feb. 1, 1993 (13 pages).
Goh , "A New a-Si:H Thin-Film Transistor Pixel Circuit for Active-Matrix Organic Light-Emitting Diodes", IEEE Electron Device Letters, vol. 24, No. 9, Sep. 2003, pp. 583-585.
International Preliminary Report on Patentability for Application No. PCT/CA2005/001007 dated Oct. 16, 2006, 4 pages.
International Search Report for Application No. PCT/CA2004/001741 dated Feb. 21, 2005.
International Search Report for Application No. PCT/CA2004/001742, Canadian Patent Office, dated Feb. 21, 2005 (2 pages).
International Search Report for Application No. PCT/CA2005/001007 dated Oct. 18, 2005.
International Search Report for Application No. PCT/CA2005/001897, dated Mar. 21, 2006 (2 pages).
International Search Report for Application No. PCT/CA2007/000652 dated Jul. 25, 2007.
International Search Report for Application No. PCT/CA2009/000501, dated Jul. 30, 2009 (4 pages).
International Search Report for Application No. PCT/CA2009/001769, dated Apr. 8, 2010 (3 pages).
International Search Report for Application No. PCT/IB2010/055481, dated Apr. 7, 2011, 3 pages.
International Search Report for Application No. PCT/IB2010/055486, dated Apr. 19, 2011, 5 pages.
International Search Report for Application No. PCT/IB2014/060959, dated Aug. 28, 2014, 5 pages.
International Search Report for Application No. PCT/IB2010/055541 filed Dec. 1, 2010, dated May 26, 2011; 5 pages.
International Search Report for Application No. PCT/IB2011/050502, dated Jun. 27, 2011 (6 pages).
International Search Report for Application No. PCT/IB2011/051103, dated Jul. 8, 2011, 3 pages.
International Search Report for Application No. PCT/IB2011/055135, Canadian Patent Office, dated Apr. 16, 2012 (5 pages).
International Search Report for Application No. PCT/IB2012/052372, dated Sep. 12, 2012 (3 pages).
International Search Report for Application No. PCT/IB2013/054251, Canadian Intellectual Property Office, dated Sep. 11, 2013; (4 pages).
International Search Report for Application No. PCT/JP02/09668, dated Dec. 3, 2002, (4 pages).
International Written Opinion for Application No. PCT/CA2004/001742, Canadian Patent Office, dated Feb. 21, 2005 (5 pages).
International Written Opinion for Application No. PCT/CA2005/001897, dated Mar. 21, 2006 (4 pages).
International Written Opinion for Application No. PCT/CA2009/000501 dated Jul. 30, 2009 (6 pages).
International Written Opinion for Application No. PCT/IB2010/055481, dated Apr. 7, 2011, 6 pages.
International Written Opinion for Application No. PCT/IB2010/055486, dated Apr. 19, 2011, 8 pages.
International Written Opinion for Application No. PCT/IB2010/055541, dated May 26, 2011; 6 pages.
International Written Opinion for Application No. PCT/IB2011/050502, dated Jun. 27, 2011 (7 pages).
International Written Opinion for Application No. PCT/IB2011/051103, dated Jul. 8, 2011, 6 pages.
International Written Opinion for Application No. PCT/IB2011/055135, Canadian Patent Office, dated Apr. 16, 2012 (5 pages).
International Written Opinion for Application No. PCT/IB2012/052372, dated Sep. 12, 2012 (6 pages).
International Written Opinion for Application No. PCT/IB2013/054251, Canadian Intellectual Property Office, dated Sep. 11, 2013; (5 pages).
Jafarabadiashtiani: "A New Driving Method for a-Si AMOLED Displays Based on Voltage Feedback"; dated 2005 (4 pages).
Kanicki, J., "Amorphous Silicon Thin-Film Transistors Based Active-Matrix Organic Light-Emitting Displays." Asia Display: International Display Workshops, Sep. 2001 (pp. 315-318).
Karim, K. S., "Amorphous Silicon Active Pixel Sensor Readout Circuit for Digital Imaging." IEEE: Transactions on Electron Devices. vol. 50, No. 1, Jan. 2003 (pp. 200-208).
Lee: "Ambipolar Thin-Film Transistors Fabricated by PECVD Nanocrystalline Silicon"; dated 2006.
Lee, Wonbok: "Thermal Management in Microprocessor Chips and Dynamic Backlight Control in Liquid Crystal Displays", Ph.D. Dissertation, University of Southern California (124 pages).
Liu, P. et al., Innovative Voltage Driving Pixel Circuit Using Organic Thin-Film Transistor for AMOLEDs, Journal of Display Technology, vol. 5, Issue 6, Jun. 2009 (pp. 224-227).
Ma E Y: "Organic light emitting diode/thin film transistor integration for foldable displays" dated Sep. 15, 1997(4 pages).
Matsueda y: "35.1: 2.5-in. AMOLED with Integrated 6-bit Gamma Compensated Digital Data Driver"; dated May 2004.
Mendes E., "A High Resolution Switch-Current Memory Base Cell." IEEE: Circuits and Systems. vol. 2, Aug. 1999 (pp. 718-721).

(56) References Cited

OTHER PUBLICATIONS

Nathan A. , "Thin Film imaging technology on glass and plastic" ICM 2000, proceedings of the 12 international conference on microelectronics, dated Oct. 31, 2001 (4 pages).
Nathan , "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Nathan: "Backplane Requirements for active Matrix Organic Light Emitting Diode Displays,"; dated 2006 (16 pages).
Nathan: "Call for papers second international workshop on compact thin-film transistor (TFT) modeling for circuit simulation"; dated Sep. 2009 (1 page).
Nathan: "Driving schemes for a-Si and LTPS AMOLED displays"; dated Dec. 2005 (11 pages).
Nathan: "Invited Paper: a-Si for AMOLED—Meeting the Performance and Cost Demands of Display Applications (Cell Phone to HDTV)"; dated 2006 (4 pages).
Office Action in Japanese patent application No. JP2012-541612 dated Jul. 15, 2014. (3 pages).
Partial European Search Report for Application No. EP 11 168 677.0, dated Sep. 22, 2011 (5 pages).
Partial European Search Report for Application No. EP 11 19 1641.7, dated Mar. 20, 2012 (8 pages).
Philipp: "Charge transfer sensing" Sensor Review, vol. 19, No. 2, Dec. 31, 1999 (Dec. 31, 1999), 10 pages.
Rafati: "Comparison of a 17 b multiplier in Dual-rail domino and in Dual-rail D L (D L) logic styles"; dated 2002 (4 pages).
Safavian: "3-TFT active pixel sensor with correlated double sampling readout circuit for real-time medical x-ray imaging"; dated Jun. 2006 (4 pages).
Safavian: "A novel current scaling active pixel sensor with correlated double sampling readout circuit for real time medical x-ray imaging"; dated May 2007 (7 pages).
Safavian: "A novel hybrid active-passive pixel with correlated double sampling CMOS readout circuit for medical x-ray imaging"; dated May 2008 (4 pages).
Safavian: "Self-compensated a-Si:H detector with current-mode readout circuit for digital X-ray fluoroscopy"; dated Aug. 2005 (4 pages).
Safavian: "TFT active image sensor with current-mode readout circuit for digital x-ray fluoroscopy [5969D-82]"; dated Sep. 2005 (9 pages).
Safavian: "Three-TFT image sensor for real-time digital X-ray imaging"; dated Feb. 2, 2006 (2 pages).
Singh "Current Conveyor: Novel Universal Active Block", Samriddhi, S-JPSET vol. I, Issue 1, 2010, pp. 41-48 (12EPPT).
Smith, Lindsay I., "A tutorial on Principal Components Analysis," dated Feb. 26, 2001 (27 pages).
Spindler, System Considerations for RGBW OLED Displays, Journal of the SID 14/1, 2006, pp. 37-48.
Stewart M. , "polysilicon TFT technology for active matrix oled displays" IEEE transactions on electron devices, vol. 48, No. 5, dated May 2001 (7 pages).
Vygranenko: "Stability of indium-oxide thin-film transistors by reactive ion beam assisted deposition"; dated 2009.
Wang: "Indium oxides by reactive ion beam assisted evaporation: From material study to device application"; dated Mar. 2009 (6 pages).
Yi He, "Current-Source a-Si:H Thin Film Transistor Circuit for Active-Matrix Organic Light-Emitting Displays", IEEE Electron Device Letters, vol. 21, No. 12, Dec. 2000, pp. 590-592.
Yu, Jennifer: "Improve OLED Technology for Display", Ph.D. Dissertation, Massachusetts Institute of Technology, Sep. 2008 (151 pages).
International Search Report for Application No. PCT/IB2014/058244, Canadian Intellectual Property Office, dated Apr. 11, 2014; (6 pages).
International Search Report for Application No. PCT/IB2014/059753, Canadian Intellectual Property Office, dated Jun. 23, 2014; (6 pages).
Written Opinion for Application No. PCT/IB2014/059753, Canadian Intellectual Property Office, dated Jun. 12, 2014 (6 pages).
International Search Report for Application No. PCT/IB2014/060879, Canadian Intellectual Property Office, dated Jul. 17, 2014 (3 pages).
Extended European Search Report for Application No. EP 14158051.4, dated Jul. 29, 2014, (4 pages).
Office Action in Chinese Patent Invention No. 201180008188.9, dated Jun. 4, 2014 (17 pages).
International Search Report for Application No. PCT/IB/2014/066932 dated Mar. 24, 2015.
Written Opinion for Application No. PCT/IB/2014/066932 dated Mar. 24, 2015.
Extended European Search Report for Application No. EP 11866291.5, dated Mar. 9, 2015, (9 pages).
Extended European Search Report for Application No. EP 14181848.4, dated Mar. 5, 2015, (8 pages).
Office Action in Chinese Patent Invention No. 201280022957.5, dated Jun. 26, 2015 (7 pages).
Extended European Search Report for Application No. EP 13794695.0, dated Dec. 18, 2015, (9 pages).
Extended European Search Report for Application No. EP 16157746.5, dated Apr. 8, 2016, (11 pages).
Extended European Search Report for Application No. EP 16192749.6, dated Dec. 15, 2016, (17 pages).
International Search Report for Application No. PCT/IB/2016/054763 dated Nov. 25, 2016 (4 pages).
Written Opinion for Application No. PCT/IB/2016/054763 dated Nov. 25, 2016 (9 pages).

* cited by examiner

SYSTEMS AND METHODS OF REDUCED MEMORY BANDWIDTH COMPENSATION

PRIORITY CLAIM

This application claims priority to Canadian Application No. 2,892,714, filed May 27, 2015, which is hereby incorporated by reference in its entirety.

FIELD OF THE INVENTION

The present disclosure relates to image compensation for light emissive visual display technology, and particularly to compensation systems and methods which exhibit reduced memory bandwidth in compensating images produced by active matrix light emitting diode device (AMOLED) and other emissive displays.

BRIEF SUMMARY

According to a first aspect there is provided a method for compensating an image produced by an emissive display system having pixels, each pixel having a light-emitting device, the method comprising: measuring characteristics of a plurality of pixels generating measurement data for use in compensation of the display; storing the measurement data in a memory; retrieving partial resolution measurement data from the measurement data stored in the memory; interpolating the measurement data generating full resolution interpolated measurement data; and compensating the display with use of the full resolution interpolated measurement data.

In some embodiments, the partial resolution measurement data comprises measurement data only for a selected subset of pixels of the display. In some embodiments measuring characteristics of a plurality of pixels comprises measuring with sub-sampling characteristics only of a selected subset of the pixels of the display system generating measurement data which is said partial resolution measurement data.

In some embodiments, measuring characteristics of a plurality of pixels comprises measuring characteristics of all of the pixels of the display system generating measurement data which comprises full resolution measurement data, and wherein retrieving partial resolution measurement data comprises retrieving with sub-sampling measurement data of only a selected subset of pixels of the display from the full resolution measurement data stored in the memory.

Some embodiments further provide for determining the selected pixels of the display so as to reduce an error between the full resolution interpolated measurement data and the full resolution measurement data.

Some embodiments further provide for, for each pixel of the display other than pixels of said selected subset of pixels of the display: predicting a corresponding interpolated pixel data portion of said full resolution interpolated measurement data; comparing said corresponding interpolated pixel data portion with a corresponding pixel data portion of said full resolution measurement data generating a predicted pixel interpolation error; and for pixels where said predicted pixel interpolation error exceeds a threshold, storing interpolation correction data for said pixel in an error table and performing said generation of said full resolution interpolated measurement data comprises determining absolute measurement data for said pixel with use of said interpolation correction data.

In some embodiments, determining absolute measurement data for said pixel comprises replacing corresponding interpolated pixel data portion of said full resolution interpolated measurement data with said interpolation correction data. In some embodiments, determining absolute measurement data for said pixel comprises replacing corresponding interpolated pixel data portion of said full resolution interpolated measurement data with absolute measurement data generated with use of said interpolation correction data and said corresponding interpolated pixel data portion.

In some embodiments, measuring characteristics of a plurality of pixels generating measurement data comprises generating low spatial frequency measurement data and high spatial frequency measurement data, storing the measurement data in the memory comprises storing the low spatial frequency measurement data and high spatial frequency measurement data in the memory, retrieving partial resolution measurement data from the measurement data stored in the memory comprises retrieving low spatial frequency partial resolution measurement data from the low spatial frequency measurement data stored in the memory and retrieving high spatial frequency partial resolution measurement data from the high spatial frequency measurement data stored in the memory, interpolating the measurement data generating full resolution interpolated measurement data comprises interpolating the low spatial frequency measurement data and interpolating the high spatial frequency measurement data and combining the interpolated low spatial frequency measurement data and the interpolated high spatial frequency measurement data together generating full resolution interpolated measurement data.

In some embodiments, a sub-sampling frequency utilized to generate partial resolution measurement data is settable by at least one of a user and the display system.

According to another aspect, there is provided a system for compensating an image produced by an emissive display system having pixels, each pixel having a light-emitting device, the system comprising: a display comprising said pixels; a monitoring system coupled to said pixels of said display and for measuring characteristics of a plurality of said pixels generating measurement data for use in compensation of the display; a memory for storing the measurement data; an interpolation module for retrieving partial resolution measurement data from the measurement data stored in the memory and interpolating the measurement data generating full resolution interpolated measurement data; and a compensation module for compensating the display with use of the full resolution interpolated measurement data.

In some embodiments, the monitoring system is for measuring characteristics of a plurality of pixels which comprises measuring with sub-sampling characteristics only of a selected subset of the pixels of the display system generating measurement data which is said partial resolution measurement data.

In some embodiments, the monitoring system is further for measuring characteristics of all of the pixels of the display system generating measurement data which comprises full resolution measurement data, and wherein the interpolation module is further for retrieving with sub-sampling measurement data of only a selected subset of pixels of the display from the full resolution measurement data stored in the memory.

Some embodiments further provide for a sub-sampling module for determining the selected pixels of the display so as to reduce an error between the full resolution interpolated measurement data and the full resolution measurement data.

In some embodiments, the interpolation module is further for, for each pixel of the display other than pixels of said selected subset of pixels of the display: predicting a corresponding interpolated pixel data portion of said full resolution interpolated measurement data; comparing said corresponding interpolated pixel data portion with a corresponding pixel data portion of said full resolution measurement data generating a predicted pixel interpolation error; and for pixels where said predicted pixel interpolation error exceeds a threshold, for storing interpolation correction data for said pixel in an error table and performing said generation of said full resolution interpolated measurement data comprises determining absolute measurement data for said pixel with use of said interpolation correction data.

In one aspect, the data is spatially sub-sampled (between a group of a few pixels, only the data for one pixel is passed to the compensation module) and an interpolation module in the compensation module creates the data samples for the other pixels in the array.

In another aspect, the data is divided into low spatial frequency and high spatial frequency. The low spatial frequency data is sampled at fewer pixels and the higher spatial frequency content is sampled at more pixels. The interpolation block creates the low frequency and high frequency content and from those data creates the accurate content for each pixel.

In another aspect, the sampled pixel can be dynamically changed to reduce the interpolation error.

In another aspect, an error table stores the data (or delta data) for pixels that interpolation creates an error beyond a threshold. The data from these pixels will be directly fetched from said error table or the data from said error table will be used to fix the error in the interpolated data.

In another aspect, the sub-sampling frequency can be set by a user or the system. In one example, for some content the compensation is not critical and so the sub-sampling frequency can be decreased. In another example, for saving power, the system may decide to reduce the sub-sampling frequency.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the disclosure will become apparent upon reading the following detailed description and upon reference to the drawings.

Figure 1:
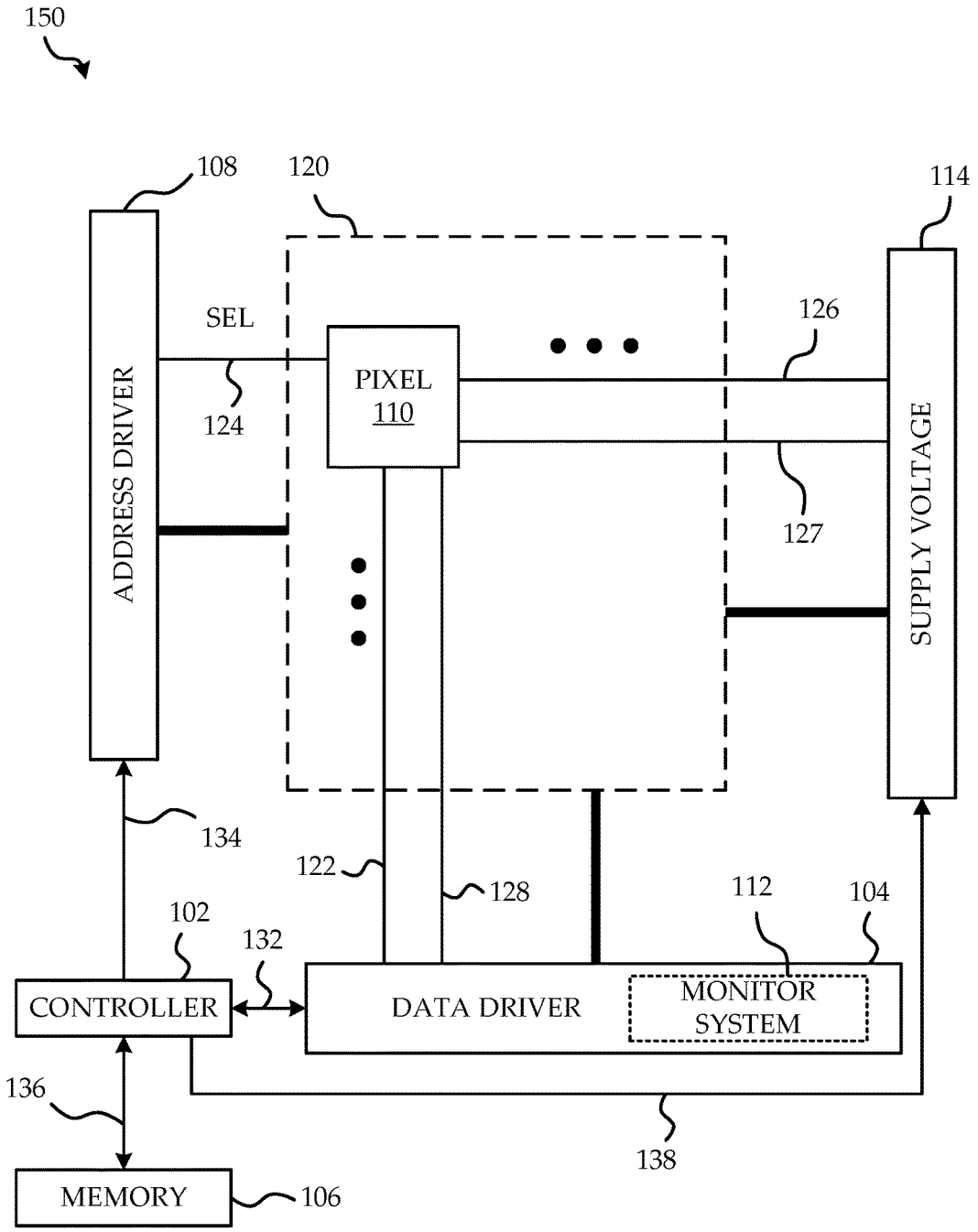
FIG. 1 illustrates an example display system which participates in and whose pixels are to be compensated with use of the compensation systems and methods disclosed.

While the present disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of an invention as defined by the appended claims.

DETAILED DESCRIPTION

Many modern display technologies suffer from defects, variations, and non-uniformities, from the moment of fabrication, and can suffer further from aging and deterioration over the operational lifetime of the display, which result in the production of images which deviate from those which are intended. Methods of image calibration and compensation are used to correct for those defects in order to produce images which are more accurate, uniform, or otherwise more closely reproduces the image represented by the image data.

As the resolution and/or frame rate of an array semiconductor device increases, or the number of issues that needed to be compensated/calibrated, the data transfer between memory and compensation module increases dramatically. This can result in higher power consumption, higher manufacturing costs, and a larger physical foot print. The systems and methods disclosed below address these issues through reduction in bandwidth.

While the embodiments described herein will be in the context of AMOLED displays it should be understood that the compensation systems and methods described herein are applicable to any other display comprising pixels, including but not limited to light emitting diode displays (LED), electroluminescent displays (ELD), organic light emitting diode displays (OLED), plasma display panels (PSP), among other displays.

It should be understood that the embodiments described herein pertain to systems and methods of compensation and do not limit the display technology underlying their operation and the operation of the displays in which they are implemented. The systems and methods described herein are applicable to any number of various types and implementations of various visual display technologies.

FIG. 1 is a diagram of an example display system 150 implementing the methods described further below. The display system 150 includes a display panel 120, an address driver 108, a data driver 104, a controller 102, and a memory storage 106.

The display panel 120 includes an array of pixels 110 (only one explicitly shown) arranged in rows and columns. Each of the pixels 110 is individually programmable to emit light with individually programmable luminance values. The controller 102 receives digital data indicative of information to be displayed on the display panel 120. The controller 102 sends signals 132 to the data driver 104 and scheduling signals 134 to the address driver 108 to drive the pixels 110 in the display panel 120 to display the information indicated. The plurality of pixels 110 of the display panel 120 thus comprise a display array or display screen adapted to dynamically display information according to the input digital data received by the controller 102. The display screen can display images and streams of video information from data received by the controller 102. The supply voltage 114 provides a constant power voltage or can serve as an adjustable voltage supply that is controlled by signals from the controller 102. The display system 150 can also incorporate features from a current source or sink (not shown) to provide biasing currents to the pixels 110 in the display panel 120 to thereby decrease programming time for the pixels 110.

For illustrative purposes, only one pixel 110 is explicitly shown in the display system 150 in FIG. 1. It is understood that the display system 150 is implemented with a display screen that includes an array of a plurality of pixels, such as the pixel 110, and that the display screen is not limited to a particular number of rows and columns of pixels. For example, the display system 150 can be implemented with a display screen with a number of rows and columns of pixels commonly available in displays for mobile devices, monitor-based devices, and/or projection-devices. In a multichannel or color display, a number of different types of pixels, each responsible for reproducing color of a particular channel or color such as red, green, or blue, will be present in the display. Pixels of this kind may also be referred to as "subpixels" as a group of them collectively provide a desired color at a particular row and column of the display, which group of subpixels may collectively also be referred to as a "pixel".

The pixel 110 is operated by a driving circuit or pixel circuit that generally includes a driving transistor and a light emitting device. Hereinafter the pixel 110 may refer to the pixel circuit. The light emitting device can optionally be an organic light emitting diode, but implementations of the present disclosure apply to pixel circuits having other electroluminescence devices, including current-driven light emitting devices and those listed above. The driving transistor in the pixel 110 can optionally be an n-type or p-type amorphous silicon thin-film transistor, but implementations of the present disclosure are not limited to pixel circuits having a particular polarity of transistor or only to pixel circuits having thin-film transistors. The pixel circuit 110 can also include a storage capacitor for storing programming information and allowing the pixel circuit 110 to drive the light emitting device after being addressed. Thus, the display panel 120 can be an active matrix display array.

As illustrated in FIG. 1, the pixel 110 illustrated as the top-left pixel in the display panel 120 is coupled to a select line 124, a supply line 126, a data line 122, and a monitor line 128. A read line may also be included for controlling connections to the monitor line. In one implementation, the supply voltage 114 can also provide a second supply line to the pixel 110. For example, each pixel can be coupled to a first supply line 126 charged with Vdd and a second supply line 127 coupled with Vss, and the pixel circuits 110 can be situated between the first and second supply lines to facilitate driving current between the two supply lines during an emission phase of the pixel circuit. It is to be understood that each of the pixels 110 in the pixel array of the display 120 is coupled to appropriate select lines, supply lines, data lines, and monitor lines. It is noted that aspects of the present disclosure apply to pixels having additional connections, such as connections to additional select lines, and to pixels having fewer connections.

With reference to the pixel 110 of the display panel 120, the select line 124 is provided by the address driver 108, and can be utilized to enable, for example, a programming operation of the pixel 110 by activating a switch or transistor to allow the data line 122 to program the pixel 110. The data line 122 conveys programming information from the data driver 104 to the pixel 110. For example, the data line 122 can be utilized to apply a programming voltage or a programming current to the pixel 110 in order to program the pixel 110 to emit a desired amount of luminance. The programming voltage (or programming current) supplied by the data driver 104 via the data line 122 is a voltage (or current) appropriate to cause the pixel 110 to emit light with a desired amount of luminance according to the digital data received by the controller 102. The programming voltage (or programming current) can be applied to the pixel 110 during a programming operation of the pixel 110 so as to charge a storage device within the pixel 110, such as a storage capacitor, thereby enabling the pixel 110 to emit light with the desired amount of luminance during an emission operation following the programming operation. For example, the storage device in the pixel 110 can be charged during a programming operation to apply a voltage to one or more of a gate or a source terminal of the driving transistor during the emission operation, thereby causing the driving transistor to convey the driving current through the light emitting device according to the voltage stored on the storage device.

Generally, in the pixel 110, the driving current that is conveyed through the light emitting device by the driving transistor during the emission operation of the pixel 110 is a current that is supplied by the first supply line 126 and is drained to a second supply line 127. The first supply line 126 and the second supply line 127 are coupled to the voltage supply 114. The first supply line 126 can provide a positive supply voltage (e.g., the voltage commonly referred to in circuit design as "Vdd") and the second supply line 127 can provide a negative supply voltage (e.g., the voltage commonly referred to in circuit design as "Vss"). Implementations of the present disclosure can be realized where one or the other of the supply lines (e.g., the supply line 127) is fixed at a ground voltage or at another reference voltage.

The display system 150 also includes a monitoring system 112. With reference again to the pixel 110 of the display panel 120, the monitor line 128 connects the pixel 110 to the monitoring system 112. The monitoring system 112 can be integrated with the data driver 104, or can be a separate stand-alone system. In particular, the monitoring system 112 can optionally be implemented by monitoring the current and/or voltage of the data line 122 during a monitoring operation of the pixel 110, and the monitor line 128 can be entirely omitted. The monitor line 128 allows the monitoring system 112 to measure a current or voltage associated with the pixel 110 and thereby extract information indicative of a degradation or aging of the pixel 110 or indicative of a temperature of the pixel 110. In some embodiments, display panel 120 includes temperature sensing circuitry devoted to sensing temperature implemented in the pixels 110, while in other embodiments, the pixels 110 comprise circuitry which participates in both sensing temperature and driving the pixels. For example, the monitoring system 112 can extract, via the monitor line 128, a current flowing through the driving transistor within the pixel 110 and thereby determine, based on the measured current and based on the voltages applied to the driving transistor during the measurement, a threshold voltage of the driving transistor or a shift thereof.

The monitoring system 112 can also extract an operating voltage of the light emitting device (e.g., a voltage drop across the light emitting device while the light emitting device is operating to emit light). The monitoring system 112 can then communicate signals 132 to the controller 102 and/or the memory 106 to allow the display system 150 to store the extracted aging information in the memory 106. During subsequent programming and/or emission operations of the pixel 110, the aging information is retrieved from the memory 106 by the controller 102 via memory signals 136, and the controller 102 then compensates for the extracted degradation information in subsequent programming and/or emission operations of the pixel 110. For example, once the degradation information is extracted, the programming information conveyed to the pixel 110 via the data line 122 can be appropriately adjusted during a subsequent programming operation of the pixel 110 such that the pixel 110 emits light with a desired amount of luminance that is independent of the degradation of the pixel 110. In an example, an increase in the threshold voltage of the driving transistor within the pixel 110 can be compensated for by appropriately increasing the programming voltage applied to the pixel 110. Generally, any data utilized for purposes of calibrating or compensating the display for the above mentioned and similar deficiencies will be referred to herein as measurement data.

Monitoring system 112 may extend to external components (not shown) for measuring characteristics of pixels which are utilized in subsequent compensation, and may include photodiodes or optical sensor arrays for directly measuring the luminance output of pixels in response to input data. Generally speaking monitoring system 112 depicted in FIG. 1 along with external modules performs necessary measurements of pixels for use in the compensation methods described below.

Figure 2:
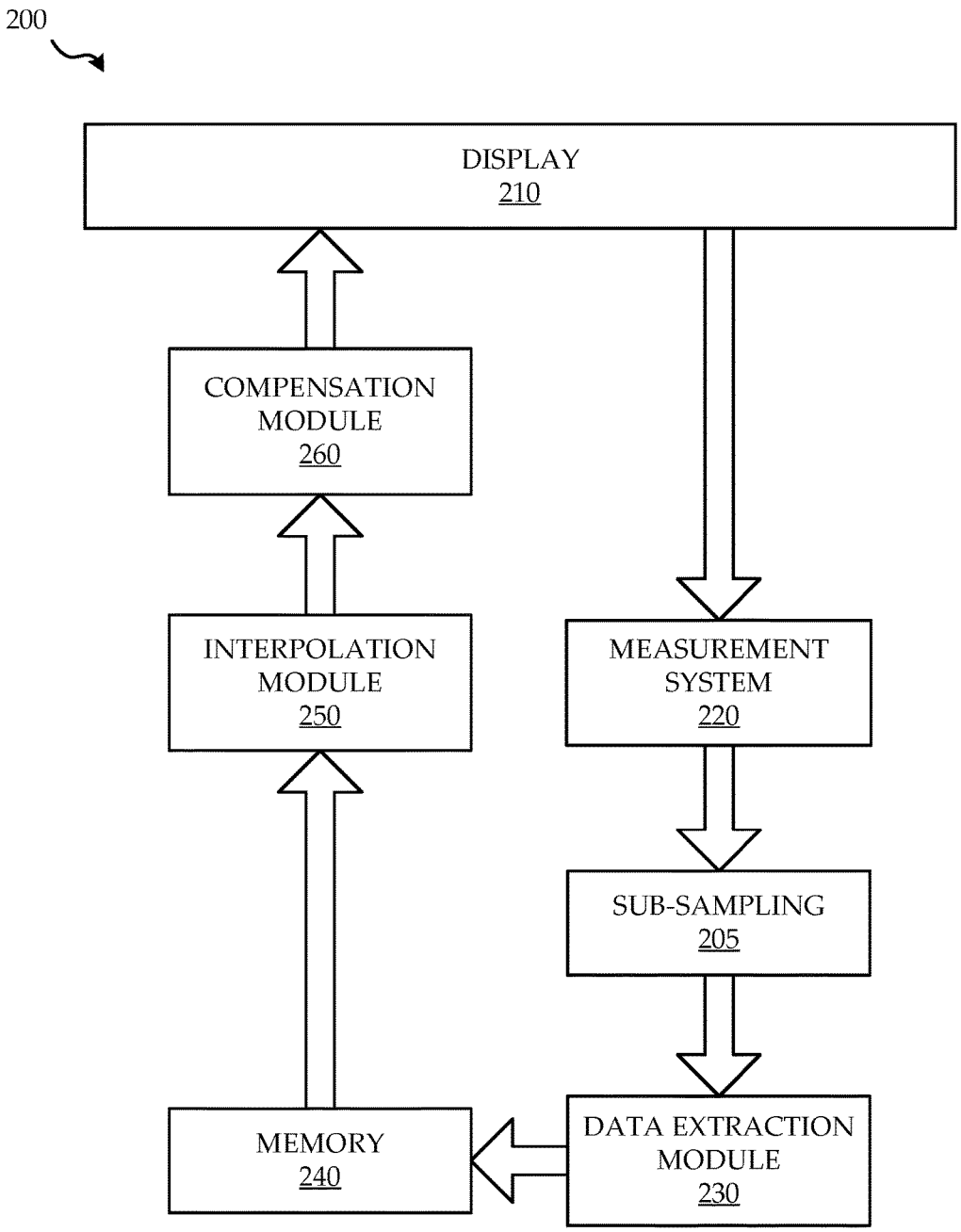
FIG. 2 is a system block diagram of reduced bandwidth compensation system and method in which data is sub-sampled prior to storage.

Referring to FIG. 2, a compensation system 200 according to an embodiment will now be described.

The compensation system 200 includes a display system 210 which is being calibrated and a measurement system 220 which may comprise the monitoring system 112 described above and may include optical sensors or any other or elements for measuring characteristics of the pixels of the display for use in deriving calibration data. Sub-sampling 205, the data extraction module 230, the interpolation module 250 and the compensation module 260 may be implemented in the controller 102 or data driver 104 of FIG. 1 or may be implemented in separate modules. In another case, sub-sampling 205, the data extraction module 230, and the interpolation module 250 can be part of the display system, for example, integrated in a timing controller TCON. The display system 210 of FIG. 2 may correspond more or less to the display system 150 of FIG. 1 and includes similar components thereof which for convenience are not shown in FIG. 2. The memory 240 may correspond to memory 106 of FIG. 1.

The measurement system 220 is arranged to measure or monitor the luminance of pixels 110 of the display panel 220 and/or other characteristics such as current and voltage of various circuit elements of the pixels 110 of the display panel 210, which measurements are utilized by the compensation module for correcting the image produced by the display as described above.

FIG. 2 shows an embodiment and method of compensation including sub-sampling measured data for which only the sub-sampled data is stored in memory 240. In one embodiment, the measurement system 220 takes measurements of the entire array of pixels 110 in the display 120 at full spatial resolution and the measured data is thereafter spatially sub-sampled by sub-sampling 205. In other words, sub-sampling 205 and data extraction module 230 serve to extract the measurement data, only for a selected subset of all the pixels of the display 210 at partial spatial resolution, from a full set of measurement data measured by the measurements system 220 and store it in memory 240. In such an embodiment, sub-sampling 205 may form part of the data extraction module 230 or may be a separate module. Spatial sub-sampling generally utilizes a technique of sampling the data, either during measurement or as described below of data retrieval, of only a fraction of pixels of a group of pixels, and generating the data for the unsampled rest of the pixels from an interpolation of data from the sampled pixels.

In some embodiments, the measurement system 220 takes measurements only of the selected subset of pixels in the array. As such, in those embodiments the measurement system 220 and sub-sampling 205 are performed simultaneously. In such an embodiment, the measurement system 220 itself performs sub-sampling 205 of measurements or sub-sampling 205 may be a separate module which cooperates with the measurement system 220 while measurements are taken. As with the embodiment described above, only measurement data for a subset of pixels is stored in memory 240.

After the measurement data has been extracted by the data extraction module 230 and the extracted information has been stored in the memory 240, only the measurement data for the subset of the pixels of the display, is passed to interpolation module 250 which utilizes an interpolation algorithm to create a full spatial resolution data set from the subset of measurement data. It follows that the sub-sampling 205, performed during measurement or performed after measurement of all of the pixels, is performed by selecting an appropriate i.e. a suitable selected subset of pixels of the display for use in deriving data for all the pixels of the display. For example, a small contiguous rectangle of pixels in only one part of the entire display would be less effective to compensate the entire display than subsampling a regular distribution of sparse pixels throughout the display area. As such, in the contemplated embodiments the particular pixels from which data is sub-sampled are predetermined either with a fixed pattern or algorithmically determined according to certain criteria. Whatever the specific subset of pixels, due to the reduction in data retrieved from memory 240 from a full spatial resolution data set to measurement data for only that subset of pixels at partial resolution, bandwidth between the memory 240 and the compensation module 260 is reduced. It should be noted that the bandwidth savings are obtained between the memory 240 and the interpolation module 250 which retrieves the measurement data and performs the interpolation for the compensation module 260, and the interpolation module 250 therefore is typically local to the compensation module 260.

Once interpolated, the full spatial resolution measurement data are used by the compensation module 260 in cooperation with the other elements of the display system, for compensating the issues related with said display array as described above in association with FIG. 1.

For the above embodiments, it is noted that after measurement and subsequent storing of the measurement data in memory 240 the subset of selected pixels is fixed and it is hard to change the set of selected subset of pixels for better interpolation. Since only the measurement data for the subset of pixels are present in the memory 240, determining how to better sub-sample the pixels with the measurement system is difficult as not all of the relevant information is available.

Figure 3:
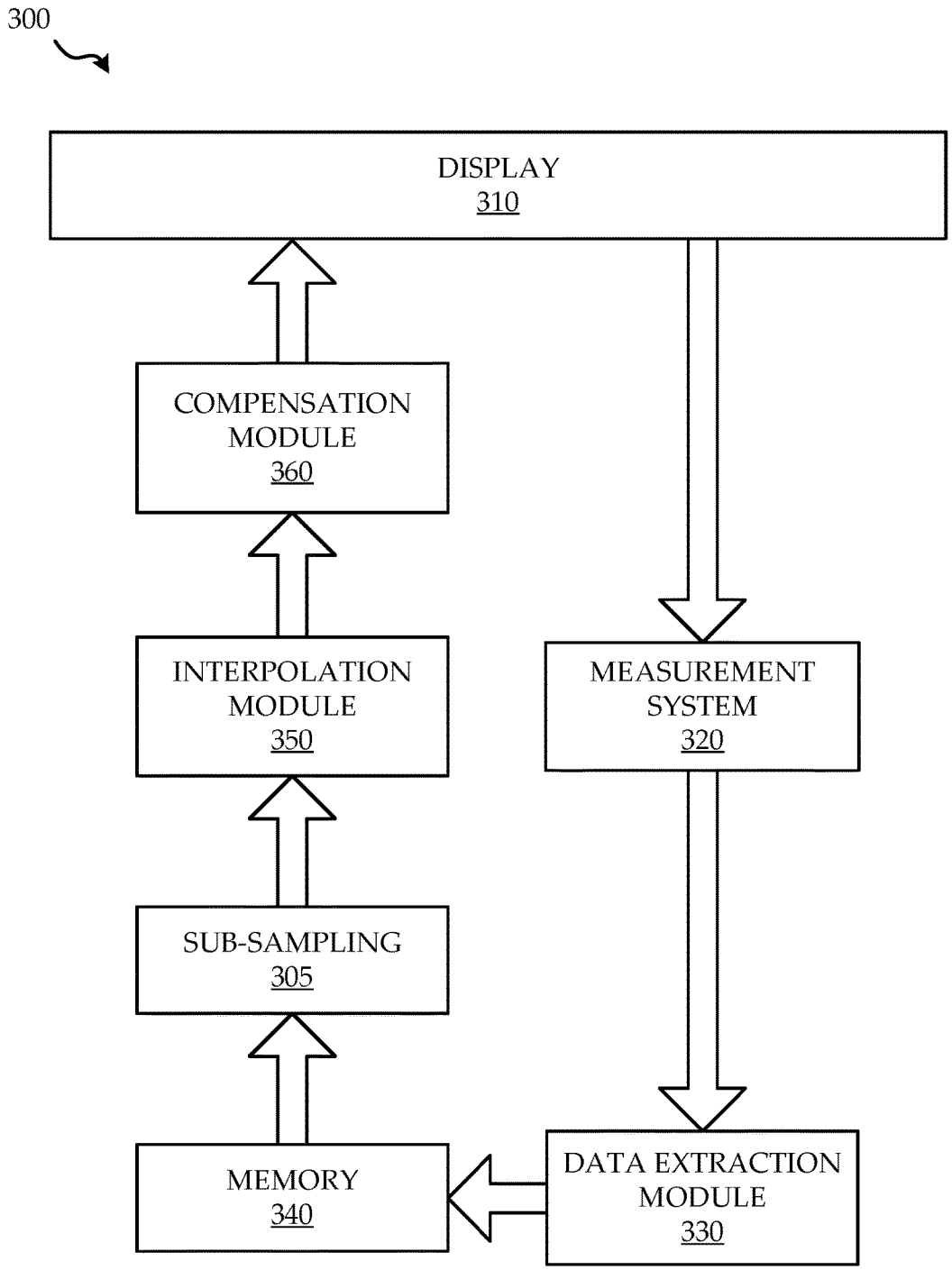
FIG. 3 is a system block diagram of reduced bandwidth compensation system and method in which data is sub-sampled after storage.

Referring also to FIG. 3, an embodiment and method of compensation including sub-sampling measured data for which measurement data for the entire display array is stored in memory, will now be described.

In the embodiment of FIG. 3, the measurement data stored in the memory 340 has the full spatial resolution of the array structure. The measurement system 320 takes measurements of the entire array of pixels in the display at full spatial resolution and data extraction module 330 extracts the full spatial resolution measurement data and stores it in memory 340.

Although full spatial resolution measurement data is stored in memory 340, only a subset of the data or partial resolution measurement data is fetched from the memory 340 by sub-sampling 305 and provided to interpolation module 350 each time data is provided to interpolation module 350 to create the full resolution data utilized by the compensation module 360. In this embodiment, sub-sampling may form part of interpolation module 350 or may be a separate module which provides the sub-sampled data to the interpolation module 350. In the embodiment of FIG. 3, because the full resolution measurement data are stored in memory 340, it can be analyzed, and measurement data from different sets of pixels may be selected to improve the interpolation output. In some embodiments this is achieved by averaging the error for each pixel. In other embodiments, because the specific algorithm used for interpolation is known, the set of selected pixels may be determined by choosing the set of pixels which optimizes, i.e., minimizes or otherwise reduces the error between the predicted interpolated data and the actual data stored in the memory 340. Whatever the specific subset of pixels, due to the reduction in data retrieved from memory 340 from a full spatial resolution data set to measurement data for only a subset of pixels at partial resolution, bandwidth between the memory 340 and the compensation and interpolation modules 350, 360 is reduced.

Figure 4:
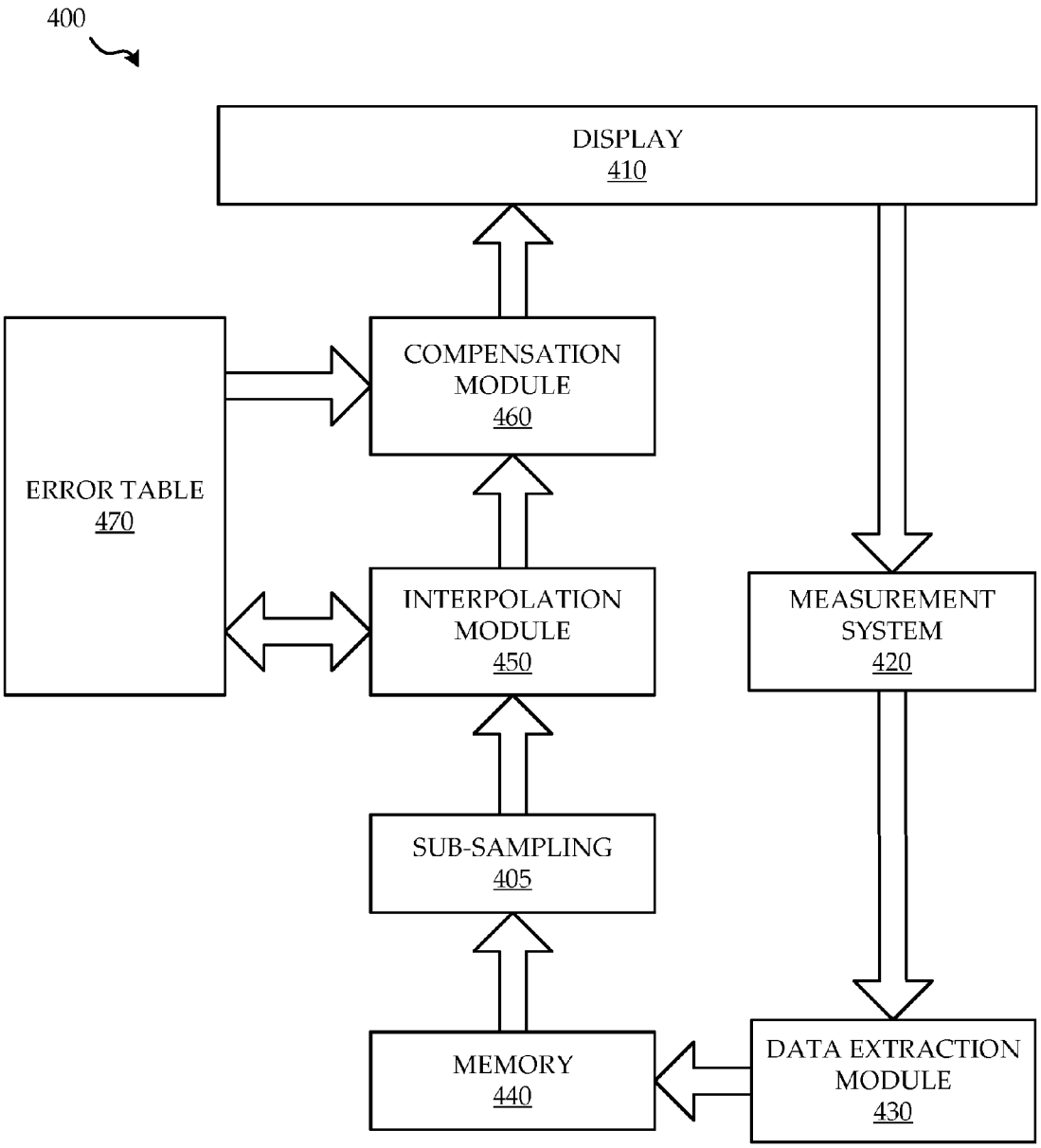
FIG. 4 is a system block diagram of reduced bandwidth compensation system and method which utilizes an error table.

Referring now also to FIG. 4, an embodiment which utilizes an error table 470 to store the measurement data of pixels with predicted interpolation errors larger than a given threshold will now be described.

As with the embodiment depicted in FIG. 3, the measurement system 420 takes measurements of the entire array of pixels in the display at full spatial resolution and data extraction module 430 extracts the full spatial resolution measurement data and stores it in memory 440.

Although full spatial resolution measurement data is stored in memory 440, only a subset of the data is fetched from the memory 440 by sub-sampling 405 and provided to interpolation module 450 each time data is provided to interpolation module 450 to create the full resolution data utilized by the compensation module 460.

Interpolation module 450 or a separate module, compares the predicted interpolated data with the full spatial resolution measurement data stored in the memory 440, determines the error of the interpolated data and generates a predicted interpolation error for each pixel. Those pixels which have predicted errors in predicted interpolated data which exceed a threshold are identified and interpolation correction data capable of being used to correct the interpolated data is stored in the error table 470 for those pixels.

In the embodiment of FIG. 4, the compensation module 460 obtains measurement data for pixels whose interpolation errors fall below the threshold directly from the interpolation module 450 as in the embodiments described above, and obtains interpolation correction data for those pixels identified as having interpolation errors larger than the threshold only from the error table 470 itself or obtains interpolation correction data from the error table 470 and interpolation data from the interpolation module 450. In a case where the compensation module 460 retrieves for a pixel the interpolation correction data only from the error table 470, the interpolation correction data stored in the error table 470 corresponds to the correct or absolute measurement data for that pixel and is used by the compensation module 460 as a replacement for the interpolated data. In a case where the compensation module 460 retrieves for a pixel interpolation correction data from the error table 470 and interpolation data from the interpolation module 450, the interpolation correction data stored in the error table 470 corresponds to the predicted error in the interpolated measurement data for that pixel and is used by the compensation module 460 along with the interpolation data received from the interpolation module 450 to calculate the correct or absolute measurement data for generating compensation data.

As with the embodiments described in association with FIG. 2 and FIG. 3, embodiments utilizing an error table 470, due to the reduction in data retrieved from memory 440 from a full spatial resolution data set to measurement data for only a subset of pixels at partial resolution, also benefit from a reduction in bandwidth between the memory 440 and the compensation and interpolation modules 460, 450. The extra transfer of data caused by usage of the error table minimally only applies to those pixels with high interpolation errors and advantageously corrects measurement data for those problematic pixels.

In some embodiments, during compensation, the data is fetched from the error table 470 by the interpolation module 450 and sent to the compensation module 460, while in other embodiments, the data is fetched from the error table 470 by compensation module 460.

Although FIG. 4 depicts the error table used in an embodiment similar to that depicted in FIG. 3, namely one for which the sub-sampling 305 is performed while fetching data from the memory 340 and prior to providing it to the interpolation module 350, the error table 470 may equally be utilized for an embodiment similar to that depicted in FIG. 2, for which only a subset of measurement data is stored in memory 240.

In some variations of any of the embodiments described above, the data is divided into low spatial frequency and high spatial frequency. The low spatial frequency data is thus sub-sampled at lower pixel resolution and the higher spatial frequency content is sub-sampled at a higher pixel resolution. As such the sub-sampling 205, 305, 405 occurs at two scales and the memory 240, 340, 440 stores two sets of subsets of pixels, one appropriate for reproducing the low spatial frequency component through interpolation, and one appropriate for reproducing the high spatial frequency component through interpolation. The interpolation module 250 creates the low frequency and high frequency content and from those data sets and recreates accurate content for each pixel. In some embodiments, the different sets of data may be stored in different memory based on the sub-sampling frequency. As described herein above, optimization or minimization of error of the measurements of the selected subsets of the pixels for use in interpolation is possible, and providing such optimization at two different scales of resolution can further improve the resulting optimization.

In some embodiments, the sub-sampling frequency and or pattern can be set by a user or by the system. In one embodiment, sub-sampling spatial frequency or pattern can be decreased for some content for which the compensation is not critical. In another example, for saving power, the system may decide to reduce the sub-sampling frequency.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of an invention as defined in the appended claims.

What is claimed is:

1. A method for compensating an image produced by an emissive display system having pixels, each pixel having a light-emitting device, the method comprising:

measuring characteristics of a plurality of pixels generating measurement data for use in compensation of the display;

storing the measurement data in a memory;

retrieving partial resolution measurement data from the measurement data stored in the memory, the partial resolution measurement data comprises measurement data only for a selected subset of pixels of the display;

interpolating the measurement data generating full resolution interpolated measurement data; wherein for each pixel of the display other than pixels of said selected subset of pixels of the display:

predicting a corresponding interpolated pixel data portion of said full resolution interpolated measurement data;

comparing said corresponding interpolated pixel data portion with a corresponding pixel data portion of said full resolution measurement data generating a predicted pixel interpolation error, and for pixels where said predicted pixel interpolation error exceeds a threshold, storing interpolation correction data for said pixels in an error table, and performing said generation of said full resolution interpolated measurement data comprises determining absolute measurement data for said pixels with use of said interpolation correction data; and compensating the display with use of the full resolution interpolated measurement data.

2. The method of claim 1 wherein measuring characteristics of a plurality of pixels comprises measuring with sub-sampling characteristics only of a selected subset of the pixels of the display system generating measurement data which is said partial resolution measurement data.

3. The method of claim 1 wherein measuring characteristics of a plurality of pixels comprises measuring characteristics of all of the pixels of the display system generating measurement data which comprises full resolution measurement data, and wherein retrieving partial resolution measurement data comprises retrieving with sub-sampling measurement data of only a selected subset of pixels of the display from the full resolution measurement data stored in the memory.

4. The method of claim 3 further comprising: determining the selected pixels of the display so as to reduce an error between the full resolution interpolated measurement data and the full resolution measurement data.

5. The method of claim 1 wherein a sub-sampling frequency utilized to generate partial resolution measurement data is settable by at least one of a user and the display system.

6. A method for compensating an image produced by an emissive display system having pixels, each pixel having a light-emitting device, the method comprising:

measuring characteristics of a plurality of pixels generating measurement data for use in compensation of the display;

storing the measurement data in a memory;

retrieving partial resolution measurement data from the measurement data stored in the memory;

interpolating the measurement data generating full resolution interpolated measurement data; and compensating the display with use of the full resolution interpolated measurement data, wherein measuring characteristics of a plurality of pixels generating measurement data comprises generating low spatial frequency measurement data and high spatial frequency measurement data, wherein storing the measurement data in the memory comprises storing the low spatial frequency measurement data and high spatial frequency measurement data in the memory, wherein retrieving partial resolution measurement data from the measurement data stored in the memory comprises retrieving low spatial frequency partial resolution measurement data from the low spatial frequency measurement data stored in the memory and retrieving high spatial frequency partial resolution measurement data from the high spatial frequency measurement data stored in the memory, and wherein interpolating the measurement data generating full resolution interpolated measurement data comprises interpolating the low spatial frequency measurement data and interpolating the high spatial frequency measurement data and combining the interpolated low spatial frequency measurement data and the interpolated high spatial frequency measurement data together generating full resolution interpolated measurement data.

7. The method of claim 6, wherein the partial resolution measurement data comprises measurement data only for a selected subset of pixels of the display.

8. The method of claim 7, further comprising for each pixel of the display other than pixels of said selected subset of pixels of the display:

predicting a corresponding interpolated pixel data portion of said full resolution interpolated measurement data;

comparing said corresponding interpolated pixel data portion with a corresponding pixel data portion of said full resolution measurement data generating a predicted pixel interpolation error; and for pixels where said predicted pixel interpolation error exceeds a threshold, storing interpolation correction data for said pixel in an error table and performing said generation of said full resolution interpolated measurement data comprises determining absolute measurement data for said pixel with use of said interpolation correction data.

9. The method of claim 8 wherein determining absolute measurement data for said pixel comprises replacing corresponding interpolated pixel data portion of said full resolution interpolated measurement data with said interpolation correction data.

10. The method of claim 8 wherein determining absolute measurement data for said pixel comprises replacing corresponding interpolated pixel data portion of said full resolution interpolated measurement data with absolute measurement data generated with use of said interpolation correction data and said corresponding interpolated pixel data portion.

11. A system for compensating an image produced by an emissive display system having pixels, each pixel having a light-emitting device, the system comprising:

a display comprising said pixels;

a monitoring system coupled to said pixels of said display and for measuring characteristics of a plurality of said pixels generating measurement data for use in compensation of the display;

a memory for storing the measurement data;

an interpolation module for retrieving partial resolution measurement data from the measurement data stored in the memory and interpolating the measurement data generating full resolution interpolated measurement data, wherein the partial resolution measurement data comprises measurement data only for a selected subset of pixels of the display; and a compensation module for compensating the display with use of the full resolution interpolated measurement data;

wherein the interpolation module is further for, for each pixel of the display other than pixels of said selected subset of pixels of the display: predicting a corresponding interpolated pixel data portion of said full resolution interpolated measurement data; comparing said corresponding interpolated pixel data portion with a corresponding pixel data portion of said full resolution measurement data generating a predicted pixel interpolation error; and for pixels where said predicted pixel interpolation error exceeds a threshold, for storing interpolation correction data for said pixel in an error table and performing said generation of said full resolution interpolated measurement data comprises determining absolute measurement data for said pixel with use of said interpolation correction data.

12. The system of claim 11 wherein the monitoring system is for measuring characteristics of a plurality of pixels which comprises measuring with sub-sampling characteristics only of a selected subset of the pixels of the display system generating measurement data which is said partial resolution measurement data.

13. The system of claim 11 wherein the monitoring system is further for measuring characteristics of all of the pixels of the display system generating measurement data which comprises full resolution measurement data, and wherein the interpolation module is further for retrieving with sub-sampling measurement data of only a selected subset of pixels of the display from the full resolution measurement data stored in the memory.

14. The system of claim 13 further comprising: a sub-sampling module for determining the selected pixels of the display so as to reduce an error between the full interpolated resolution measurement data and the full resolution measurement data.

15. The system of claim 11 wherein a sub-sampling frequency utilized to generate partial resolution measurement data is settable by at least one of a user and the display system.

16. A system for compensating an image produced by an emissive display system having pixels, each pixel having a light-emitting device, the system comprising:

a display comprising said pixels;

a monitoring system coupled to said pixels of said display and for measuring characteristics of a plurality of said pixels generating measurement data for use in compensation of the display;

a memory for storing the measurement data;

an interpolation module for retrieving partial resolution measurement data from the measurement data stored in the memory and interpolating the measurement data generating full resolution interpolated measurement data; and a compensation module for compensating the display with use of the full resolution interpolated measurement data;

wherein measuring characteristics of a plurality of pixels generating measurement data comprises generating low spatial frequency measurement data and high spatial frequency measurement data, wherein storing the measurement data in the memory comprises storing the low spatial frequency measurement data and high spatial frequency measurement data in the memory, wherein retrieving partial resolution measurement data from the measurement data stored in the memory comprises retrieving low spatial frequency partial resolution measurement data from the low spatial frequency measurement data stored in the memory and retrieving high spatial frequency partial resolution measurement data from the high spatial frequency measurement data stored in the memory, and wherein interpolating the measurement data generating full resolution interpolated measurement data comprises interpolating the low spatial frequency measurement data and interpolating the high spatial frequency measurement data and combining the interpolated low spatial frequency measurement data and the interpolated high spatial frequency measurement data together generating full resolution interpolated measurement data.

17. The system of claim 16 wherein the partial resolution measurement data comprises measurement data only for a selected subset of pixels of the display.

18. The system of claim 17 wherein the interpolation module is further for, for each pixel of the display other than pixels of said selected subset of pixels of the display: predicting a corresponding interpolated pixel data portion of said full resolution interpolated measurement data; comparing said corresponding interpolated pixel data portion with a corresponding pixel data portion of said full resolution measurement data generating a predicted pixel interpolation error; and for pixels where said predicted pixel interpolation error exceeds a threshold, for storing interpolation correction data for said pixel in an error table and performing said generation of said full resolution interpolated measurement data comprises determining absolute measurement data for said pixel with use of said interpolation correction data.

19. The system of claim 18 wherein determining absolute measurement data for said pixel comprises replacing corresponding interpolated pixel data portion of said full resolution interpolated measurement data with said interpolation correction data.

20. The system of claim 18 wherein determining absolute measurement data for said pixel comprises replacing corresponding interpolated pixel data portion of said full resolution interpolated measurement data with absolute measurement data generated with use of said interpolation correction data and said corresponding interpolated pixel data portion.

* * * * *